US011562837B2

(12) United States Patent
Kanegae

(10) Patent No.: US 11,562,837 B2
(45) Date of Patent: Jan. 24, 2023

(54) CIRCUIT SUBSTRATE

(71) Applicant: KOA CORPORATION, Nagano (JP)

(72) Inventor: Satoshi Kanegae, Nagano (JP)

(73) Assignee: KOA CORPORATION, Nagano (JP)

( * ) Notice: Subject to any disclaimer, the term of this patent is extended or adjusted under 35 U.S.C. 154(b) by 0 days.

(21) Appl. No.: 17/387,349

(22) Filed: Jul. 28, 2021

(65) Prior Publication Data

US 2022/0044849 A1 Feb. 10, 2022

(30) Foreign Application Priority Data

Aug. 5, 2020 (JP) ..... JP2020-133049

(51) Int. Cl.
*H01C 7/00* (2006.01)
*H01C 1/14* (2006.01)
*H01C 1/01* (2006.01)

(52) U.S. Cl.
CPC ..... *H01C 7/006* (2013.01); *H01C 1/01* (2013.01); *H01C 1/14* (2013.01)

(58) Field of Classification Search
CPC . H01C 7/006; H01C 1/10; H01C 1/14; H01C 1/012; H01C 3/06; H01C 3/10; H01C 3/12
See application file for complete search history.

(56) References Cited

U.S. PATENT DOCUMENTS 10,403,420 B2 * 9/2019 Okada ..... H01C 1/01
10,488,270 B2 * 11/2019 Suzuki ..... G01K 7/183
2004/0196138 A1 * 10/2004 Thei ..... H01C 17/0656 257/E27.047
2008/0012624 A1 * 1/2008 Kamatani ..... H01L 27/0629 257/E27.047
2008/0290460 A1 * 11/2008 Iseki ..... H01C 1/14 257/536
2017/0301436 A1 * 10/2017 Okada ..... H01C 7/003
2018/0285509 A1 * 10/2018 Lo ..... G06F 30/392

FOREIGN PATENT DOCUMENTS

JP 2009-130174 6/2009

* cited by examiner

*Primary Examiner* — Kyung S Lee
(74) *Attorney, Agent, or Firm* — Greenblum & Bernstein, P.L.C.

(57) ABSTRACT

Particularly, it is an object to provide a circuit substrate that can reduce a field intensity near an electrode having a high potential. A circuit substrate of the present invention includes an insulated substrate, a thin-film resistive element, and electrodes electrically connected to both sides of the thin-film resistive element, the thin-film resistive element and the electrodes being disposed on a surface of the insulated substrate. The circuit substrate is characterized in that the thin-film resistive element has a pattern in which a resistance wire is repeatedly folded back, and a dummy wire for reducing a field intensity is provided on a high-potential electrode side.

3 Claims, 6 Drawing Sheets

CIRCUIT SUBSTRATE

TECHNICAL FIELD

The present invention relates to a circuit substrate including a thin-film resistive element on an insulated substrate.

BACKGROUND ART

A circuit substrate applied to a thin-film resistor includes a thin-film resistive element having a predetermined pattern by vapor deposition or a photolithographic technique. The thin-film resistive element has a repeated fold-back pattern (which may also be called a meander pattern) (see Patent Literature 1). Electrodes are electrically connected to both ends of the thin-film resistive element.

CITATION LIST

Patent Literature

[Patent Literature 1] Japanese Patent Laid-Open No. 2009-130174

SUMMARY OF INVENTION

Problem to be Solved by the Invention

By the way, a field intensity near an electrode having a high potential increases in a conventional thin-film resistive element, and as a result, the temporal changes of the resistance value become large, which disadvantageously reduces the product life.

Accordingly, the present invention has been made in view of the above problem, and particularly, it is an object of the present invention to provide a circuit substrate that can reduce a field intensity near an electrode having a high potential.

Means for Solving the Problem

The present invention is a circuit substrate including an insulated substrate, a thin-film resistive element, and electrodes electrically connected to both sides of the thin-film resistive element, the thin-film resistive element and the electrodes being disposed on a surface of the insulated substrate, characterized in that the thin-film resistive element has a pattern in which a resistance wire is repeatedly folded back, and a dummy wire for reducing a field intensity is provided on a high-potential electrode side.

According to the present invention, the dummy wire is preferably provided continuously to the fold-back pattern of the resistance wire. For example, a form can be exemplified in which the dummy wire is folded back to outside from the resistance wire positioned outermost of the fold-back pattern.

Furthermore, according to the present invention, the dummy wire preferably branches off from the resistance wire. For example, a form can be exemplified in which the dummy wire branches off from a fold vertex of the resistance wire.

According to the present invention, a plurality of the dummy wires are preferably provided.

Advantageous Effect of Invention

According to the present invention, a dummy wire is disposed on a side having an electrode having a high potential so that a field intensity can be reduced. Thus, temporal changes of the resistance value can be reduced, and an increase in product life can be attempted.

BRIEF DESCRIPTION OF DRAWINGS

FIG. 3(*b*) is a potential distribution diagram on a measurement line for potential/field intensity shown in FIG. 3(*a*), and FIG. 3(*c*) is a field intensity distribution diagram.

FIG. 5(*b*) is a potential distribution diagram at a measurement point for potential/field intensity shown in FIG. 5(*a*), and FIG. 5(*c*) is a field intensity distribution diagram.

MODE FOR CARRYING OUT THE INVENTION

Embodiments of the present invention (hereinafter, each simply called "embodiment") are described in detail below. It should be noted that the present invention is not limited to the following embodiments, but various changes can be made thereto without departing from the spirit and scope.

Figure 7:
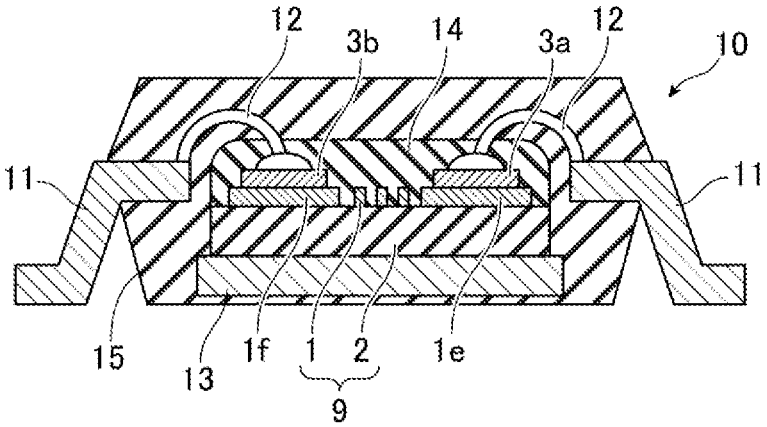
FIG. 7 is a partial cross-sectional view of a thin-film resistor including a circuit substrate of an embodiment.

A circuit substrate according to an embodiment is applied to a chip resistor, a resistance network and the like, and for example, a thin-film resistor 10 including the circuit substrate according to the embodiment has a cross section shown in FIG. 7.

As shown in FIG. 7, reference numeral "2" denotes an insulated substrate, and a thin-film resistive element 1 having a pattern in which a resistance wire is repeatedly folded back is provided on a surface of the insulated substrate 2. Wide parts 1*e* and 1*f* are provided on both ends of the thin-film resistive element 1. Electrodes 3*a* and 3*b* are provided on surfaces of the wide parts 1*e* and 1*f*, respectively, and the thin-film resistive element 1 and the electrodes 3*a* and 3*b* are electrically connected. As shown in FIG. 7, the electrodes 3*a* and 3*b* and terminals 11 are electrically connected via wires 12. A die pad 13 is provided on a back surface of the insulated substrate 2. The terminals 11 and the die pad 13 construct a lead frame.

It should be noted that a circuit substrate 9 includes the insulated substrate 2, the thin-film resistive element 1 and the electrodes 3*a* and 3*b*.

As shown in FIG. 7, the surfaces of the thin-film resistive element 1 and the electrodes 3*a* and 3*b* are covered by a protective film 14. Furthermore, the components of the thin-film resistor 10 except for the terminals 11 are covered by a mold resin 15.

The insulated substrate 2 is made of, for example, ceramics such as an alumina sintered body having electric insulation although the material is not limited. The thin-film resistive element 1 is made of, for example, ruthenium oxide ($RuO_2$), Cu—Ni or the like. The terminals 11 are formed of a material on which reflow soldering can be performed. The electrodes 3*a* and 3*b* are formed of a conductive material having a better electric conductivity than the thin-film resistive element 1. The protective film 14 and the mold resin 15 are molded with, for example, an epoxy-based insulating resin.

It should be noted that FIG. 7 does not show a dummy wire (which is described below) that is a characteristic of this embodiment.

<Outline of Thin-Film Resistive Element in Comparison Example>

Figure 8:
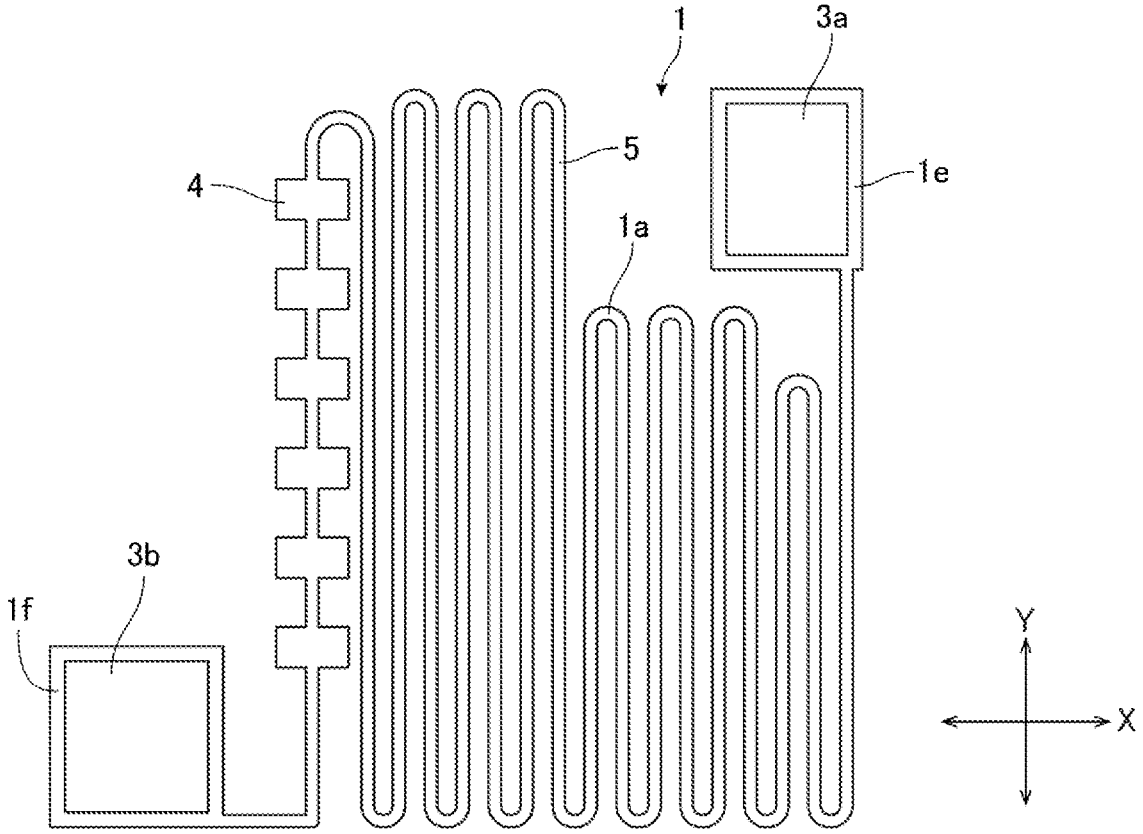
Fig. 8 Related Art
FIG. 8 is a plan view of a thin-film resistive element according to a comparison example.

FIG. 8 shows a plan view of a thin-film resistive element in a comparison example. Here, an X direction and a Y direction shown in FIG. 8 indicate two directions that are orthogonal within a surface of the insulated substrate.

The thin-film resistive element 1 is provided on a surface of the insulated substrate 2 shown in FIG. 7, and the thin-film resistive element 1 and the insulated substrate 2 construct the circuit substrate 9 although the insulated substrate 2 is not shown in the figure but the thin-film resistive element 1 is only shown.

As shown in FIG. 8, the thin-film resistive element 1 has a fold-back pattern 1*a* in which a resistance wire extends in the Y direction and is alternately folded back such that the folded wires face each other at predetermined intervals in the X direction, and wide parts 1*e* and 1*f* that are wider than the width of the wiring are provided on both ends of the fold-back pattern. Electrodes 3*a* and 3*b* are provided on surfaces of the wide parts 1*e* and 1*f*, respectively. As shown in FIG. 8, the electrodes 3*a* and 3*b* are disposed at positions away from each other in the X direction.

It should be noted that, as shown in FIG. 8, a resistance pattern 4 for resistance value adjustment is provided between the electrode 3*b* (wide part 1*f*) and the fold-back pattern 1*a*.

<Problem of Thin-Film Resistive Element in Comparison Example>

Voltage as high as, for example, several hundred V to several thousand V is applied to between the first electrode 3*a* and the second electrode 3*b* which are away from each other at both ends in the X direction and have the fold-back pattern 1*a* therebetween. Thus, near the electrode having a high potential (hereinafter, called "high-potential electrode"), the potential rapidly decreases, and the field intensity is greatly increased. As a result, corrosion easily occurs near the high-potential electrode, which causes a problem that the temporal changes of the resistance value become large.

<Outline of Thin-Film Resistive Element in First Embodiment>

Accordingly, as a result of keen examinations, the present inventor provides a dummy wire for reducing the field intensity near the high-potential electrode so that the rapid decrease of the potential can be alleviated and the field intensity near the high-potential electrode can be reduced, compared with the comparison example in FIG. 8. As a result, corrosion near the high-potential electrode can be suppressed, and the temporal changes of the resistance value can be small, compared with the comparison example.

Figure 1:
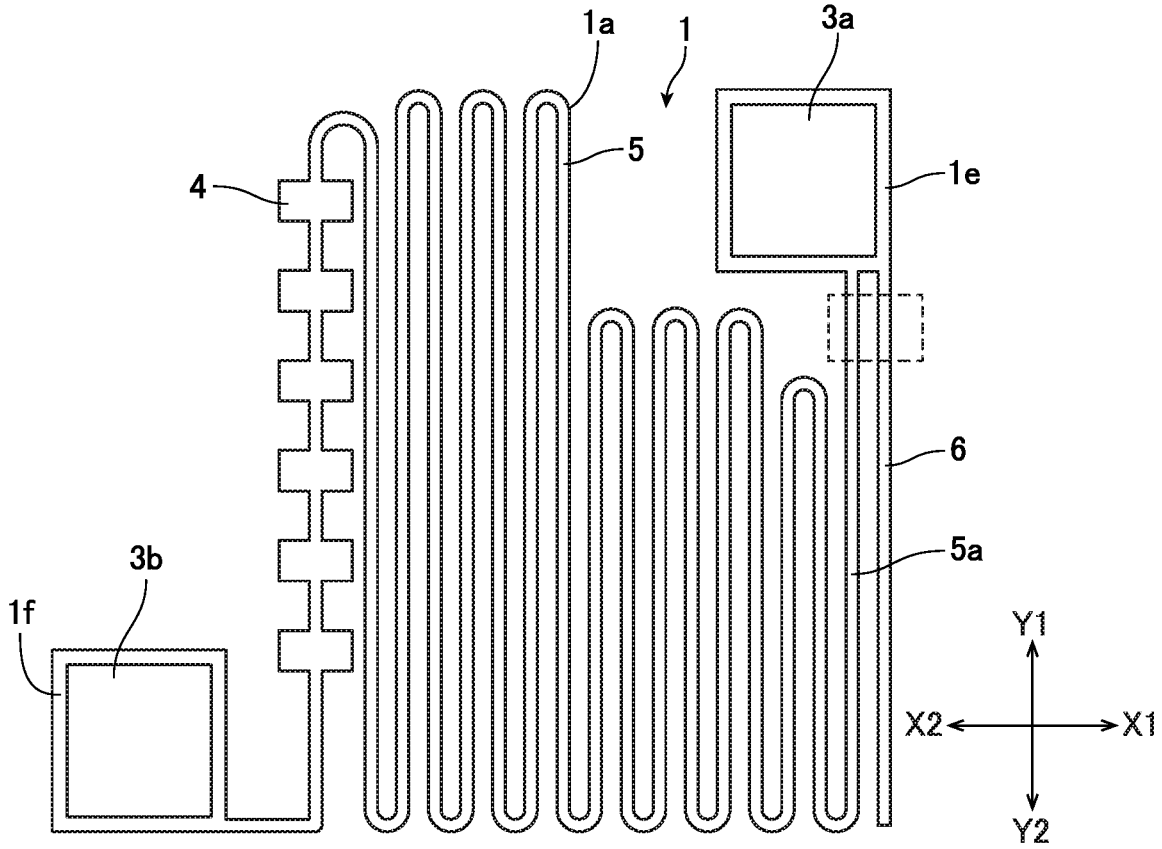
FIG. 1 is a plan view of a thin-film resistive element according to a first embodiment of the present invention.

FIG. 1 is a plan view of a thin-film resistive element according to a first embodiment. As shown in FIG. 1, a thin-film resistive element 1 has one fold-back pattern 1*a* in which a resistance wire 5 extends in a Y1-Y2 direction and is repeatedly folded back at predetermined intervals in an X1-X2 direction orthogonal to the Y1-Y2 direction. Here, the number of turns and the length of extension in the Y1-Y2 direction of the resistance wire 5 can be changed variously in accordance with the resistance value to be required.

The thin-film resistive element 1 is provided on a surface of the insulated substrate 2 shown in FIG. 7, and the thin-film resistive element 1 and the insulated substrate 2 construct the circuit substrate 9, although the insulated substrate 2 is not shown in the figure and the thin-film resistive element 1 is only shown. The same is true for FIG. 4.

As shown in FIG. 1, wide parts 1*e* and 1*f* that are wider than the line width of the resistance wire 5 are provided integrally with the fold-back pattern 1*a* on both ends in the X1-X2 direction of the resistance wire 5. In other words, the wide parts 1*e* and 1*f* are disposed away from each other in the X1-X2 direction orthogonal to the Y1-Y2 direction that is the direction of extension of the resistance wire 5. As shown in FIG. 1, the first wide part 1*e* is provided at a tip on the Y1 side of the resistance wire 5*a* positioned outermost on the shown X1 side of the fold-back pattern 1*a*. On the other hand, the second wide part 1*f* positioned on the shown X2 side is provided at an end on the X2 side of the fold-back pattern 1*a* via a resistance pattern 4 for resistance value adjustment. The resistance pattern 4 is provided integrally with the fold-back pattern 1*a* and the wide part 1*f*. The shape and provided position of the resistance pattern 4 can be arbitrarily changed. Resistance adjustment can be performed by trimming the resistance pattern 4.

As shown in FIG. 1, a first electrode 3*a* is provided on a surface of the first wide part 1*e*, and a second electrode 3*b* is provided on a surface of the second wide part 1*f*. Thus, the electrodes 3*a* and 3*b* are disposed away from each other in the X1-X2 direction orthogonal to the Y1-Y2 direction that is the direction of extension of the resistance wire 5. Each of the electrodes 3*a* and 3*b* has, but not limited to, a smaller area in some degree than those of the wide parts 1*e* and 1*f*.

After a resistive film and an electrode film are formed by sputtering or vapor deposition, all of the resistance wire 5 and the electrodes 3*a* and 3*b* can be formed so as to have a predetermined pattern form by using a photolithography technique.

As shown in FIG. 1, the length of extension in the Y1-Y2 direction of the resistance wire 5 decreases in a stepwise manner from the shown X2 side to the shown X1 direction. According to this embodiment, the length of extension of the resistance wire 5 is short such that a space can be provided on the shown X1 side and the shown Y1 side. Thus, the first wide part 1*e* and the first electrode 3*a* can be efficiently arranged in the provided space.

Figure 2:
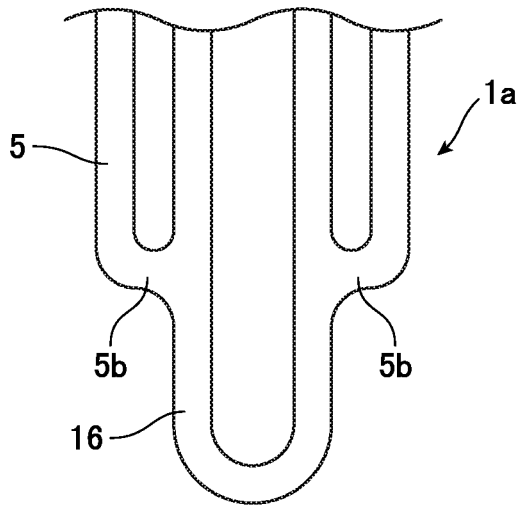
FIG. 2 is a partially enlarged plan view showing an enlarged part of the thin-film resistive element in FIG. 1.

Although FIG. 2 shows a part (particularly near the fold vertex) of the fold-back pattern 1*a* shown in FIG. 1, a resistance pattern 16 for resistance adjustment may be integrally connected between fold vertices 5*b* of the resistance wire 5 included in the fold-back pattern 1*a* as shown in FIG. 2. Resistance adjustment can be performed by trimming the resistance pattern 16. In the fold-back pattern 1*a* shown in FIG. 1, the resistance pattern 16 can be provided at the fold vertices 5*b* of the resistance wire 5 that is folded back on the shown Y2 side or at the fold vertices 5*b* of the resistance wire 5 that is folded back on the shown Y1 side. However, preferably, on the shown Y1 side, the resistance pattern 16 is not provided in the resistance wire 5 the length of extension of which decreases in a stepwise manner and that is closer to the first electrode 3*a*, but is disposed at the fold vertices 5*b* of the resistance wire 5 the length of extension of which is long and that is away from the first electrode 3*a*. Thus, resistance adjustment can be easily performed by trimming.

According to this embodiment, as shown in FIG. 1, a dummy wire 6 is provided which is continuous from the resistance wire 5*a* positioned outermost on the shown X1 side of the fold-back pattern 1*a* via the first wide part 1*e*. The dummy wire 6 is folded back to outside of the resistance wire 5*a*.

According to this embodiment, by providing the dummy wire 6 near the first electrode 3*a* that is a high-potential side electrode, the decrease of the potential can be alleviated, and the field intensity can be reduced.

Although, referring to FIG. 1, the dummy wire 6 is folded back to outside of the resistance wire 5*a* positioned outermost, the dummy wire 6 may be folded back to inside. However, folding back the dummy wire 6 to outside provides a sufficient space for the dummy wire 6 so that the dummy wire 6 can be easily formed and that the dummy wire 6 can have a length equal to that of the resistance wire 5*a*, which can reduce the field intensity more effectively. It should be noted that the dummy wire 6 may be provided on both of the outside and inside of the resistance wire 5*a*.

The line width of the dummy wire 6 is substantially equal to the line width of the resistance wire 5*a* in this embodiment although the line width of the dummy wire 6 is not limited.

<Outline of Thin-Film Resistive Element in Second Embodiment>

Figure 4:
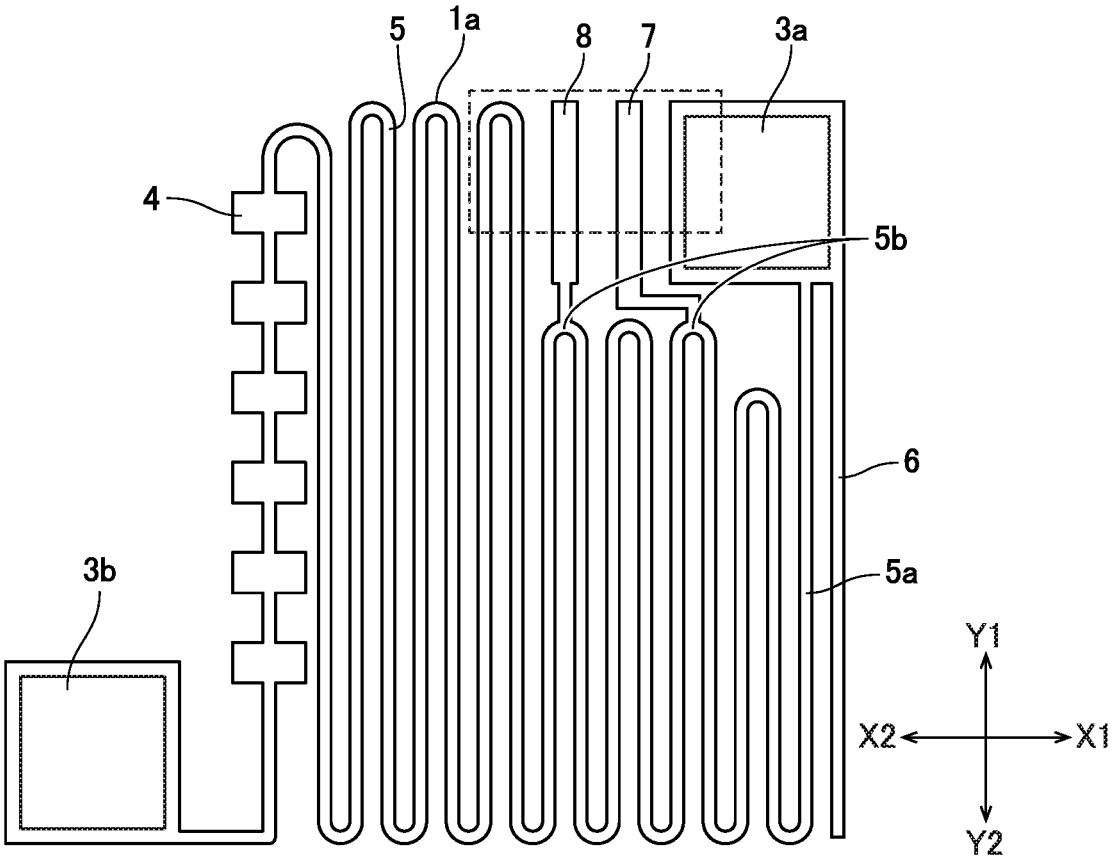
FIG. 4 is a plan view of a thin-film resistive element according to a second embodiment of the present invention.

Next, with reference to FIG. 4, a pattern in a thin-film resistive element according to a second embodiment is described.

In an embodiment shown in FIG. 4, dummy wires 7 and 8 branch off from the resistance wire 5 constructing the fold-back pattern 1*a*. It should be noted that the dummy wires 7 and 8 are called branch type dummy wires 7 and 8 below.

As shown in FIG. 4, the branch type dummy wires 7 and 8 are provided near the first electrode 3*a* that is a high-potential electrode, and according to this embodiment, extend to a position facing the first electrode 3*a* in the X1-X2 direction. Both of the branch type dummy wires 7 and 8 branch off from the fold vertices 5*b* of the resistance wire 5 to the Y1 direction. The length of extension in the Y1-Y2 direction of the resistance wire 5 decreases in a stepwise manner toward the shown X1 direction so that a space is provided near the first electrode 3*a*. Thus, by using this space, the branch type dummy wires 7 and 8 can branch off from the fold vertices 5*b* of the resistance wire 5 and can extend to a position facing the first electrode 3*a* in the X1-X2 direction. Therefore, the branch type dummy wires 7 and 8 can be formed reasonably and such that the effect of reduction of the field intensity can be effectively exerted.

According to this embodiment, the branch type dummy wires 7 and 8 are provided near the first electrode 3*a* that is the high-potential side electrode so that the decrease of the potential can be alleviated and the field intensity can be reduced.

In the embodiment in FIG. 4, the dummy wire 6 is folded back on the outside of the resistance wire 5*a* positioned outermost of the fold-back pattern 1*a*, like the one in FIG. 1. Thus, more effectively, the decrease of the potential can be alleviated, and the field intensity can be reduced.

However, referring to FIG. 4, the dummy wire 6 may not be provided, and only the branch type dummy wires 7 and 8 may be provided.

The branch type dummy wires 7 and 8 shown in FIG. 4 having a substantially equal line width to that of the resistance wire 5 branch off from the fold vertex 5*b* of the resistance wire 5, and the branch type dummy wires 7 and 8 in the part facing the first electrode 3*a* in the X1-X2 direction have a wide line width, but the line widths of the branch type dummy wires 7 and 8 are not limited thereto.

A plurality of dummy wires are preferably provided so that, more effectively, the decrease of the potential can be alleviated and the field intensity can be reduced.

A potential distribution and a field intensity distribution of a part enclosed by a dashed line of the embodiment shown in FIGS. 1 and 4 are described below.

<Potential Distribution and Field Intensity Distribution>

Figure 3A:
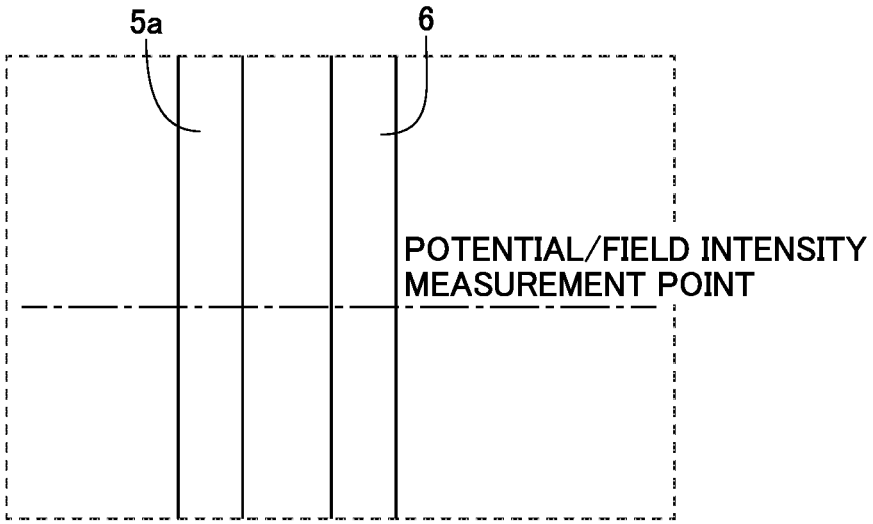
FIG. 3(*a*) is a partially enlarged plan view showing an enlarged part enclosed by a dashed line in FIG. 1.
Figure 3B:
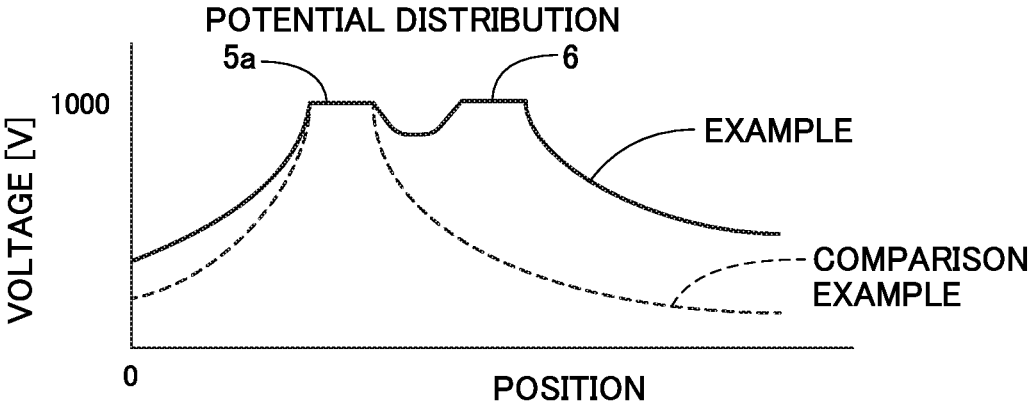
Figure 3C:
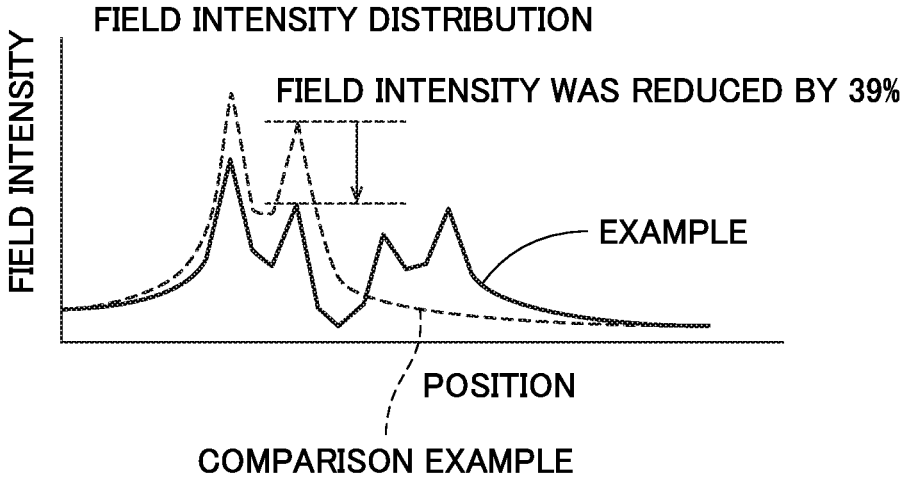

FIG. 3(*a*) is an enlarged view of the part enclosed by the dashed line shown in FIG. 1. FIG. 3(*a*) shows the resistance wire 5*a* positioned outermost of the fold-back pattern 1*a* and the dummy wire 6 folded back to outside of the resistance wire 5*a* with a space therebetween.

FIG. 3(*b*) shows a potential distribution when voltage of 1000 V is applied to between the electrodes 3*a* and 3*b*. It should be noted that the potential distribution in FIG. 3(*b*) is a distribution diagram at a potential measurement point indicated by an alternate long and short dashed line in FIG. 3(*a*).

A solid line shown in FIG. 3(*b*) is a potential distribution diagram of an example including the dummy wire 6, and a dashed line therein is a potential distribution diagram without the dummy wire 6 in the comparison example in FIG. 8. As shown in FIG. 3(*b*), in the comparison example, it was found that the potential rapidly decreased on both sides of the resistance wire 5*a*. On the other hand, in the example, it was found that, because of the dummy wire 6, the potential at the position where the dummy wire 6 is provided could be increased, and compared with the comparison example, the decrease of the potential on both sides of the resistance wire 5*a* could be effectively alleviated.

FIG. 3(*c*) shows a field intensity distribution. It should be noted that the field intensity distribution in FIG. 3(*c*) is a distribution diagram at the field intensity measurement point indicated by the alternate long and short dashed line in FIG. 3(*a*). A solid line shown in FIG. 3(*c*) is a field intensity distribution diagram of the example including the dummy wire 6, and a dashed line therein is a field intensity distribution diagram without the dummy wire 6 in the comparison example in FIG. 8.

As shown in FIG. 3(*c*), it was found that, in the example, the field intensity could be reduced more than the comparison example, and that, in the simulation result, the field intensity could be reduced by about 39% compared with the comparison example.

Figure 5A:
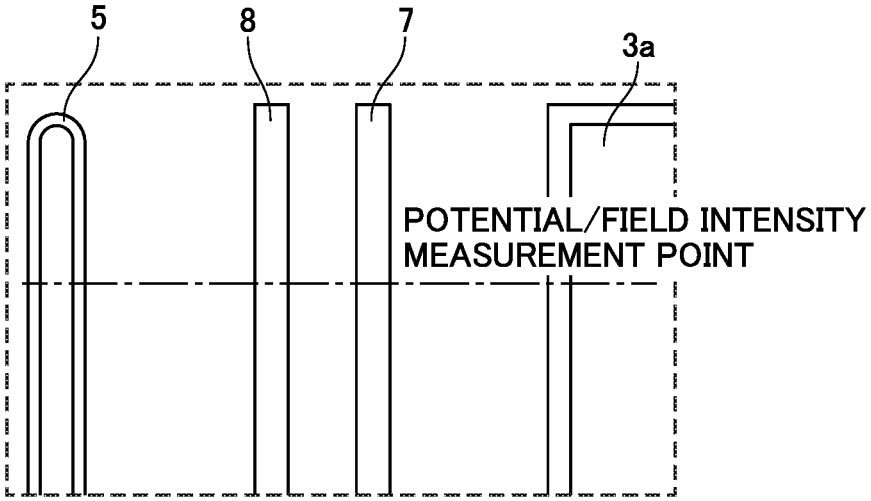
FIG. 5(*a*) is a partially enlarged plan view showing an enlarged part enclosed by a dashed line in FIG. 4.
Figure 5B:
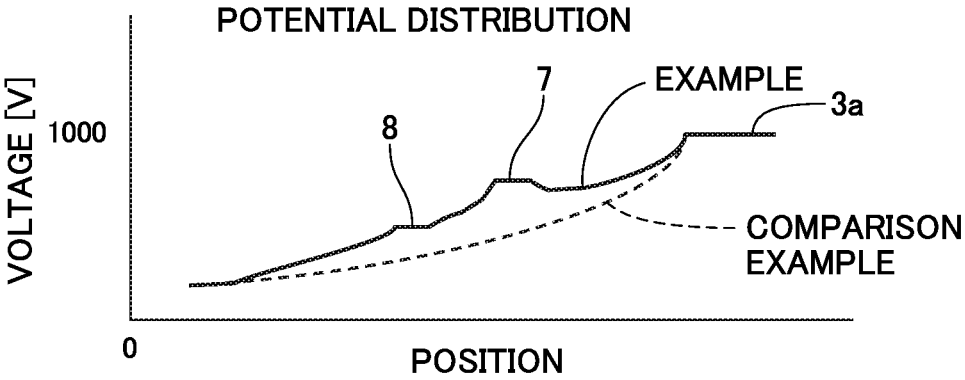
Figure 5C:
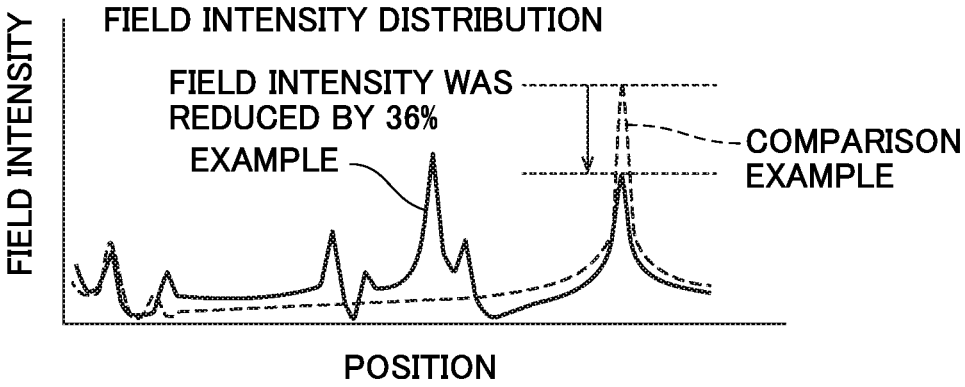

Next, FIG. 5(*a*) is an enlarged view of the part enclosed by a dashed line shown in FIG. 4. FIG. 5(*a*) shows the first electrode 3*a*, the resistance wire 5, and the branch type dummy wires 7 and 8 positioned between the first electrode 3*a* and the resistance wire 5.

FIG. 5(*b*) shows a potential distribution when voltage of 1000 V is applied to between the electrodes 3*a* and 3*b*. It should be noted that the potential distribution in FIG. 5(*b*) is a distribution diagram at the potential measurement point indicated by an alternate long and short dashed line in FIG. 5(*a*).

A solid line shown in FIG. 5(*b*) is a potential distribution diagram of an example including the branch type dummy wires 7 and 8, and a dashed line therein is a potential distribution diagram without the branch type dummy wires 7 and 8 in the comparison example in FIG. 8. As shown in FIG. 5(*b*), it was found that, in the comparison example, the potential rapidly decreased near the first electrode 3*a*. On the other hand, it was found that, in the example, because of the branch type dummy wires 7 and 8, the potential could be increased at the positions where the branch type dummy wires 7 and 8 were provided, and compared with the comparison example, the potential decrease near the first electrode 3*a* could be effectively alleviated.

FIG. 5(*c*) shows a field intensity distribution. It should be noted that the field intensity distribution in FIG. 5(*c*) is a distribution diagram at the field intensity measurement point indicated by the alternate long and short dashed line in FIG. 5(*a*). A solid line shown in FIG. 5(*c*) is a field intensity distribution diagram of an example including the branch type dummy wires 7 and 8, and a dashed line therein is a field intensity distribution diagram without a dummy wire in the comparison example in FIG. 8.

As shown in FIG. 5(*c*), it was found that, in the example, the field intensity could be reduced more than the comparison example, and in the simulation result, the field intensity could be reduced by about 36% compared with the comparison example.

<Regarding Improvement Effect>

Figure 6:
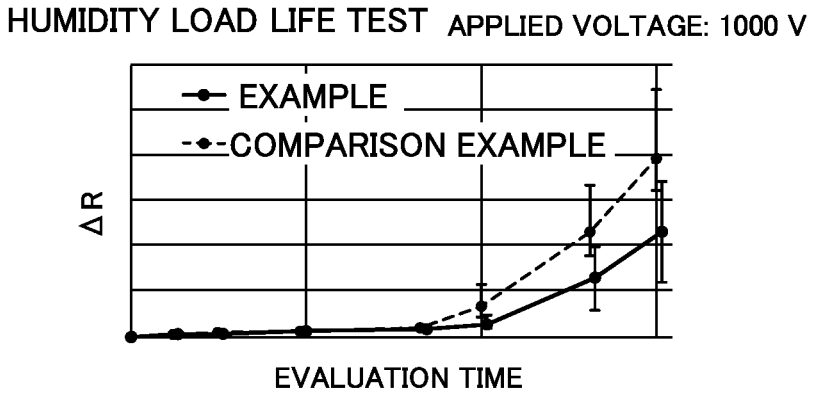
FIG. 6 is a graph showing a relationship between evaluation time and ΔR in humidity load life tests according to an example and a comparison example.

Next, an improvement effect of the example is described. FIG. 6 is a graph showing a relationship between evaluation time and ΔR in humidity load life tests according to an example and a comparison example. In the example, an experiment was performed by using the thin-film resistive element shown in FIG. 4. In the comparison example, an experiment was performed by using the thin-film resistive element shown in FIG. 8.

In the experiments, applied voltage was 1000 V, and temporal changes of the resistance value were measured under an environment with a temperature of 85° C. and a humidity of 85%.

As shown in FIG. 6, it was found that the changes of the resistance value could be smaller in the example than the comparison example. This is because, in the example, the field intensity can be reduced compared with the comparison example, and corrosion can be suppressed. In this way, in the example, it was found that the changes of the resistance value could be small and an increase in product life could be promoted.

According to the experiment, ion migration did not occur in the comparison example, and corrosion of metal was a problem. The resistance pattern used in the experiment was a structure having electrodes on both sides of a fold-back pattern in which a resistance wire is repeatedly folded back. Furthermore, the resistance wire extends in the Y1-Y2 direction and is repeatedly folded back at intervals in the X1-X2 direction orthogonal to the Y1-Y2 direction, and the electrodes are disposed away from each other on the both sides in the X1-X2 direction. When high voltage is applied to between the electrodes in the pattern arrangement, corrosion of metal is a problem with an increase in field intensity near the high-potential electrode. Accordingly, in the example, a dummy wire for attempting reduction of the field intensity was provided near the high-potential electrode so that occurrence of corrosion was suppressed.

INDUSTRIAL APPLICABILITY

With the thin-film resistive element of the present invention, the field intensity can be reduced, and temporal changes of the resistance value can be small. The circuit substrate having the thin-film resistive element of the present invention is applicable to a chip resistor, a resistance network and the like.

REFERENCE SIGNS LIST

1 Thin-film resistive element
1*a* Fold-back pattern
1*e*, 1*f* Wide part
2 Insulated substrate
3*a*, 3*b* Electrode
4, 16 Resistance pattern
5, 5*a* Resistance wire
5*b* Fold vertex
6 Dummy wire
7, 8 Branch type dummy wire
9 Circuit substrate
10 Thin-film resistor
11 Terminal
12 Wire
13 Die pad
14 Protective film
15 Mold resin

The invention claimed is:

1. A circuit substrate comprising:
an insulated substrate;
a thin-film resistive element; and
electrodes electrically connected to both sides of the thin-film resistive element, wherein the thin-film resistive element and the electrodes are disposed on a surface of the insulated substrate,
wherein the thin-film resistive element has a fold-back pattern in which a resistance wire is repeatedly folded back,
wherein a dummy wire for reducing a field intensity is provided on a high-potential electrode side, and
wherein the dummy wire is continuously formed with the fold-back pattern via the electrode, which has a superior electrical conductivity than that of the thin-film resistive element, and/or the dummy wire branches off from a fold vertex of the resistance wire.

2. The circuit substrate according to claim 1, wherein the dummy wire that is continuously formed with the fold-back pattern is folded back to outside from the resistance wire positioned outermost of the fold-back pattern.

3. The circuit substrate according to claim 1, wherein a plurality of the dummy wires that are continuously formed with the fold-back pattern are provided.

* * * * *